US005645414A

United States Patent [19]

Wang

[11] Patent Number: 5,645,414

[45] Date of Patent: Jul. 8, 1997

[54] CHILD-RESISTANT, AUTOMATICALLY LOCKING LIGHTER

[75] Inventor: Zhengge Wang, Vancouver, Canada

[73] Assignee: American Tectrade Enterprises, Vancouver, Canada

[21] Appl. No.: 550,376

[22] Filed: Oct. 30, 1995

[30] Foreign Application Priority Data

Jun. 23, 1995 [CN] China ..... 95 2 13586.8

[51] Int. Cl.[6] ..... F23D 11/36

[52] U.S. Cl. ..... 431/153; 431/277

[58] Field of Search ..... 431/153, 277

[56] References Cited

U.S. PATENT DOCUMENTS

| | | | |
|---|---|---|---|
| 4,717,335 | 1/1988 | Loveless . | |
| 5,085,578 | 2/1992 | Hunter . | |
| 5,092,764 | 3/1992 | McDonough et al. . | |
| 5,125,829 | 6/1992 | McDonough et al. . | |
| 5,145,358 | 9/1992 | Shike et al. . | |
| 5,165,885 | 11/1992 | Iwahori | 431/153 |
| 5,197,870 | 3/1993 | Yang | 431/153 |
| 5,213,493 | 5/1993 | Iwahuri . | |
| 5,213,495 | 5/1993 | Pan . | |
| 5,215,458 | 6/1993 | Cirami . | |
| 5,224,854 | 7/1993 | Ansquer . | |
| 5,236,351 | 8/1993 | Tien . | |
| 5,271,731 | 12/1993 | Hsin-Chung | 431/153 |
| 5,324,193 | 6/1994 | Pan | 431/153 |
| 5,439,375 | 8/1995 | Wang | 431/153 |

FOREIGN PATENT DOCUMENTS

| | | |
|---|---|---|
| 1294451 | 1/1991 | Canada . |
| 1280619 | 2/1991 | Canada . |
| 1281197 | 3/1991 | Canada . |
| 1322861 | 10/1993 | Canada . |
| 1286618 | 2/1995 | Canada . |
| 2269003 | 7/1993 | United Kingdom . |

*Primary Examiner*—Carl D. Price
*Attorney, Agent, or Firm*—Brian M. Long

[57] ABSTRACT

A child-resistant, automatically locking lighter includes a fuel tank having a fuel tank cover, a valve for controllably releasing fuel from the tank, a spark wheel, a flint for generating a spark to ignite released fuel, and lever for opening and closing the valve. A retainer unit mounted on the tank cover includes an abutment and a retainer hook. The lever includes a latch hook extending toward the hook of the retainer unit, and an abutment engageable with the abutment of the lever. A spring mounted between the tank cover and the lever urges the lever into a locked position in which the abutments prevent the lever from pivoting to open the valve. The lever is capable of being manually slid to a released position, in which the abutments are disengaged and the lever is free to pivot to open the valve. As the lever is displaced from the locked to the released positions, the retainer hook and the latch hook engage, to retain the lever in the released position against the force of the spring. The latch hook disengages from the retainer hook when the lever is subsequently pivoted to open the fuel valve, such that the lever is automatically returned to the locked position by the spring following each use of the lighter.

8 Claims, 7 Drawing Sheets

CHILD-RESISTANT, AUTOMATICALLY LOCKING LIGHTER

BACKGROUND OF THE INVENTION

1. Field of the Invention

The present invention relates to a child-resistant lighter, and in particular to an automatically locking child-resistant lighter.

2. Description of the Related Art

A conventional lighter generally comprises a fuel tank having a fuel tank cover, a valve for controllably releasing fuel from the tank, a spark wheel and flint for generating a spark to ignite released fuel, and a lever for opening and closing the valve. The spark wheel, flint, lever and valve are conveniently arranged on the tank cover so that a user can readily rotate the spark wheel and pivot the lever to open the valve and reliably effect the release and ignition of fuel. A child-resistant lockable lighter is described in U.S. Pat. No. 5,439,375, issued Aug. 8, 1995 to Zhengge Wang, in which the lever is capable of sliding between a locked position, in which the lever is prevented from pivoting and the lighter is thereby rendered inoperative, and a released position, in which the lever is capable of its normal pivoting action to open the fuel valve. In use, the lever is first manually pulled from the locked position to the released position. At this stage, the lighter can be used normally. Following use, the lever is manually pushed back to its locked position to again render the lighter inoperative. Using this arrangement, the lever can be so designed that the force required to move the lever back and forth is greater than that which can be exerted by a child, thereby rendering the lighter child resistant.

A drawback of the above described invention is that the lever must be manually pulled into the released position and then manually pushed back to the locked position. These additional steps are inconvenient, so that a user may simply keep the lever in the released position, thereby maintaining the lighter permanently in an operative condition, and defeating the child resistant and safety features afforded by the locking position of the lever.

SUMMARY OF THE INVENTION

It is accordingly an object of the present invention to provide a child resistant lighter in which the lever will automatically return to the locked position following each use of the lighter.

In accordance with the present invention, there is provided a child resistant lighter which has a fuel valve operatively disposed in a tank cover for controllably releasing fuel from a fuel tank, with a spark wheel, a flint and a spring urging the flint against said spark wheel to produce a spark on rotation of the spark wheel. A lever mounted on the tank cover has a first end operatively engaged with the fuel valve and a second end. The lever is slidable towards the fuel valve into a locked position, in which the fuel valve remains in a closed condition, and the second end of the lever engages an abutment on the tank cover to prevent pivotation of the lever relative to the tank cover, and is also slidable away from the fuel valve into a released position, in which the second end thereof is released from the abutment and the lever is free to pivot from the released position to an actuated position so as to open the valve. A spring resiliently urges the lever towards the locked position. The lighter includes a first retainer on the tank cover and a second retainer on the lever. The second retainer is engageable with first retainer against the action of the spring for releasibly retaining the lever in the released position. The second retainer is also disengageable from the first retainer, by pivotation of the lever from the released position to the actuated position, to thereby allow the lever to be automatically returned to the locked position by the spring following each use of the lighter.

Conveniently, the first retainer is part of a retainer unit which includes a generally flat support flange for securing the retainer unit to the tank cover, and a post extends from the support flange and substantially normal to the plane thereof to support the abutment.

In one embodiment of the present invention, the spring comprises a torsional spring. The torsional spring is preferably mounted on a pivot so that respective arms of the spring bear against the tank cover and the lever. The pivot is conveniently mounted on the retaining unit, so that We support flange thereof serves to fasten the pivot, as well as the post to the tank cover.

Additionally, an arm of the torsional spring preferably includes a shackle for pivotably connecting the respective arm of the spring to the lever. In this embodiment of the present invention, the torsional spring is a double torsional spring, and two arms of the spring engage the lever through the shackle, and two arms of the spring bear against the tank cover.

In another embodiment of the present invention, the spring is formed as an S-shaped reed spring. In this case, one end of the reed spring comprises a bearing surface for bearing against a portion of the tank cover, while the other end of the reed spring includes a shackle for pivotable engagement with the lever. The locking unit can conveniently include a receptacle for receiving the beating surface of the reed spring, and for thereby securely retaining the reed spring in place.

BRIEF DESCRIPTION OF THE DRAWINGS

Further objects features and advantages of the present invention will be more readily apparent from the following detailed description thereof given, by way of example, with reference to the appended drawings, in which.

It will be noted that throughout the drawings, like elements are identified by like reference numerals.

DETAILED DESCRIPTION OF THE PREFERRED EMBODIMENTS

A first embodiment of the present invention will described with reference to FIGS. 1–6.

Figure 1:
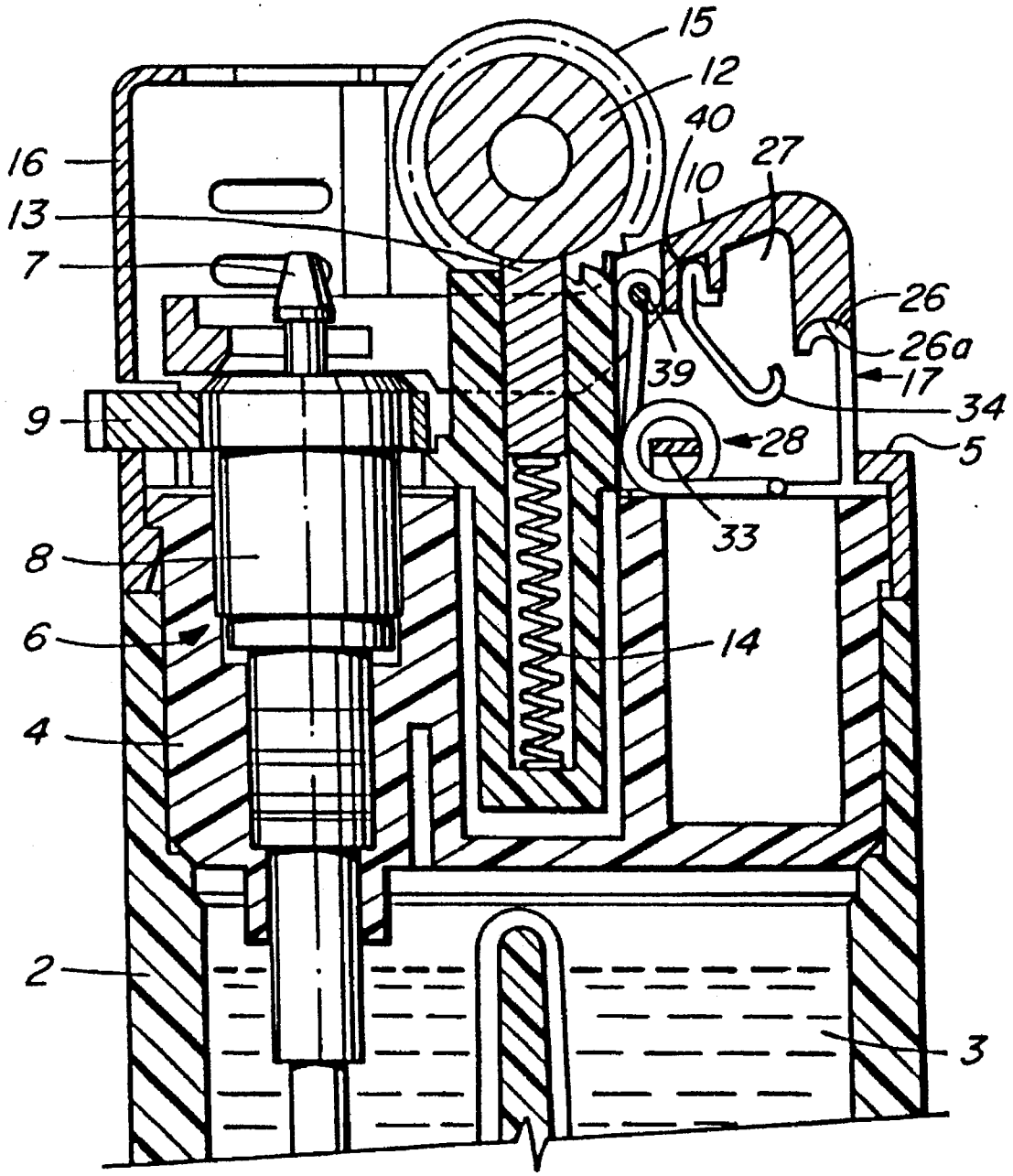
FIG. 1 is a cross-section view showing a first embodiment of the present invention in a locked condition.

Referring to FIG. 1, a lighter generally indicated by reference numeral 1 typically comprises a fuel tank 2 in which is stored a quantity of fuel 3, such as, for example, liquid butane. The top of the tank is closed by a fuel tank cover 4 welded to the tank 2, and is typically surrounded by a bracket 5.

A valve 6 having a nozzle 7, a valve body 8 and an adjusting ring 9 is mounted through the tank cover to permit the controlled release of fuel 3 from the tank 2. Typically, the valve 6 is opened and closed by a lever 10 which pivots about protrusions (not shown) of the tank cover 4 defining a fulcrum, to raise and lower the valve nozzle 7 with respect to the valve body 8, and the rate at which fuel 3 is released from the opened valve 6, and correspondingly the height of a flame 11 produced by the burning fuel, are controlled by the adjusting ring 9. Such a fulcrum is well known in the art and is disclosed for example, in the aforementioned U.S. Pat. No. 5,439,375, the disclosure of which is incorporated herein by reference.

Conventionally, a spark wheel 12 is rotatably mounted on the tank cover 4, and a flint element 13 is urged by a helical spring 14 to bear against the spark wheel 12. Thumb pressure exerted on a side wheel 15 of the spark wheel 12 by a user (not shown) causes rotation of the spark wheel 12 to project a number of sparks (not shown) into the region surrounding the nozzle 7 and thereby to ignite fuel as it is released from the opened valve.

Typically, a wind cap 16 surrounds the region of the nozzle 7 to prevent gusts of air from extinguishing the flame 11.

The above-described elements and operation of a lighter are well known in the art, and therefore a more detailed description thereof will not be provided herein.

Figure 5:
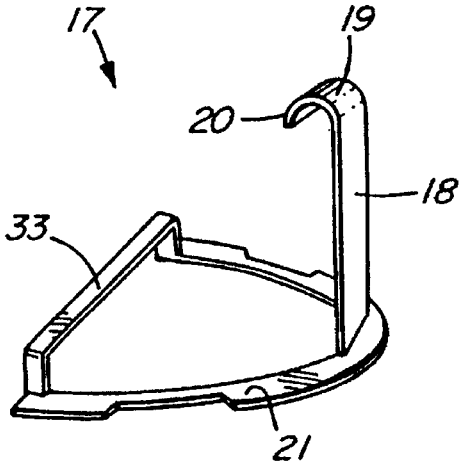
FIG. 5 is a perspective view of a locking unit employed in the embodiment of FIG. 1.

In accordance with the present invention, the lighter 1 includes retainer unit 17 mounted on the tank cover 4. As illustrated in FIG. 5, the retainer unit 17 includes an upright post 18 having an abutment in the form of a downwardly concave curved top 19 at an upper free end thereof. A first retainer in the form of a retainer hook 20 is formed by the top 19. The retainer unit 17 can conveniently be formed by die stamping a piece of sheet metal, and can be fastened to the tank cover 4 by any suitable means. For example, the retainer unit 17 can conveniently be formed with a support flange 21 which can be secured to the upper surface of the tank cover 4 by means of the bracket 5. For this purpose, the support flange 21 can be formed in a U-shape as illustrated in FIG. 5, so as to generally conform to the shape of the portion of the tank cover 4 proximal to the retainer unit 17.

Figure 2:
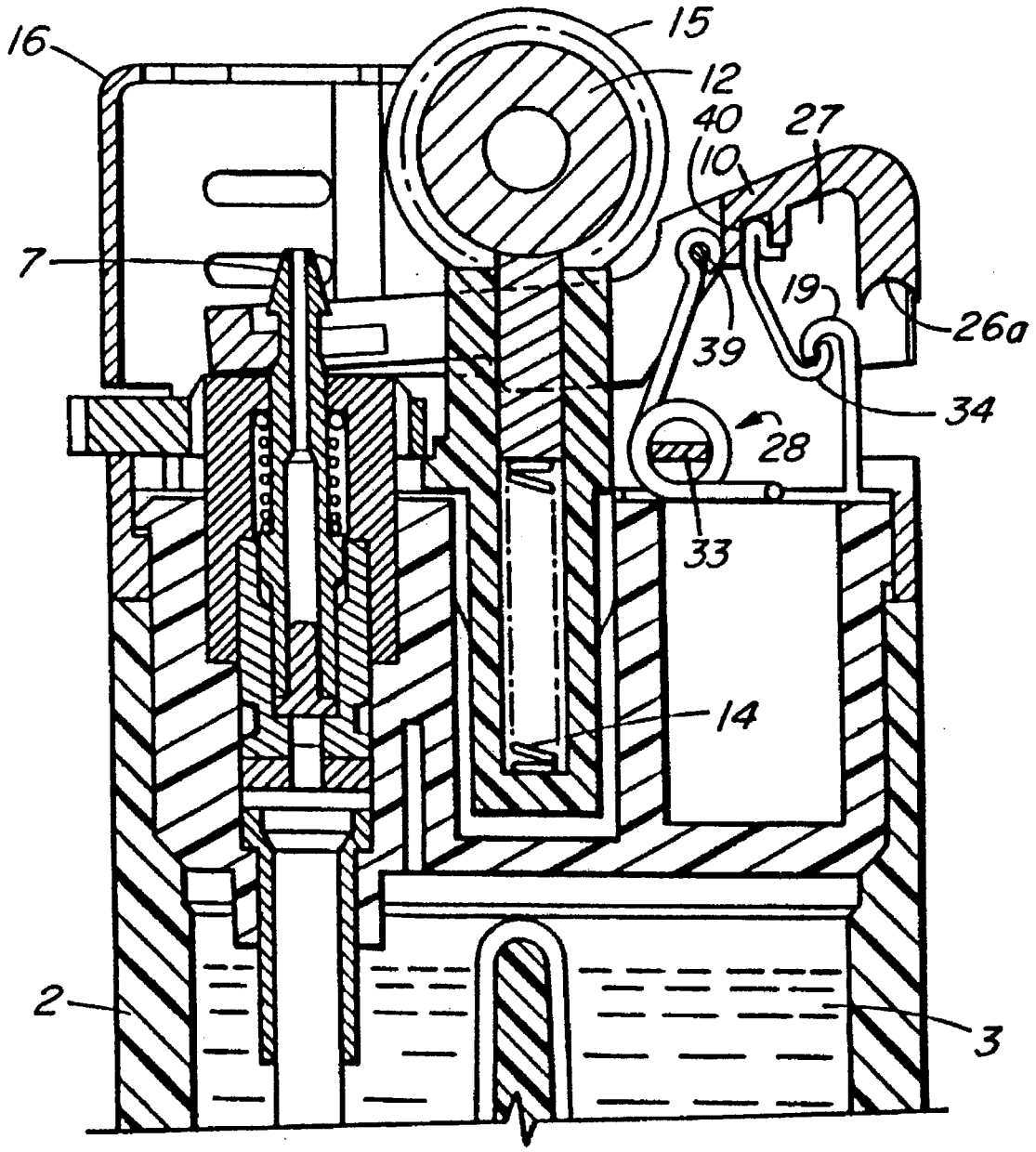
FIG. 2 is a cross-section view showing the embodiment of FIG. 1 in a released condition.

The lever 10 has a first end thereof operatively connected to the valve nozzle 7 and is slidable between a locked position, shown in FIG. 1, and a released position, shown in FIG. 2. For this purpose, the first end of the lever 10 is conveniently provided with a longitudinal slot 22 (FIG. 4) which permits the lever 10 to slide horizontally with respect to the valve 6, while maintaining operative connection with the valve nozzle 7 so that the lever 10 can open the valve 6. A through-hole 23 which communicates with the longitudinal slot 22 can conveniently be provided to permit the lever 10 to be easily fitted onto the valve nozzle 7 during assembly of the lighter 1. The other or second end of the lever 10 is provided with a widened portion 24 to facilitate pivoting of the lever 10 by finger or thumb pressure applied by a user. The widened portion 24 further includes a knurled portion 25 to allow a user to grasp the lever. The extreme end of the widened portion 24 is provided with an abutment 26 (FIG. 1), which may conveniently be formed by a thickened wall portion. The abutment 26 has a downwardly concave underside 26a which interfits with the top 19 of the retainer unit 17 when the lever 10 is in the locked position, as shown in FIG. 1, and thereby prevents the lever 10 from pivoting and opening the valve 6. A cavity 27 formed within the widened portion 24 adjacent the abutment 26 permits the lever 10 to be pivoted, without interfering with the locking unit 17, from the released position (FIG. 2) to an actuated position (FIG. 3).

Figure 3:
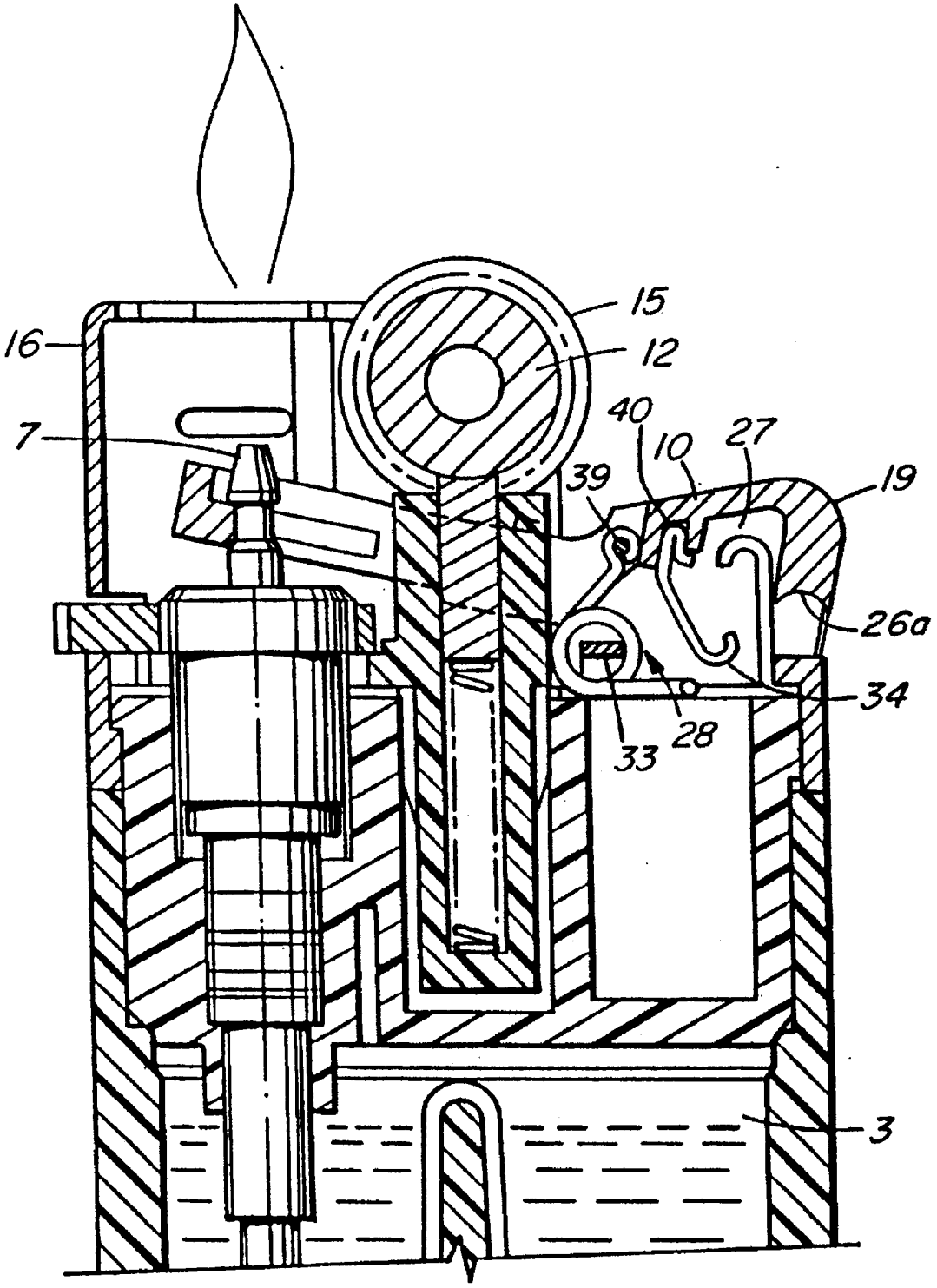
FIG. 3 is a cross-section view showing the embodiment of FIG. 1 in an in-use condition.
Figure 4:
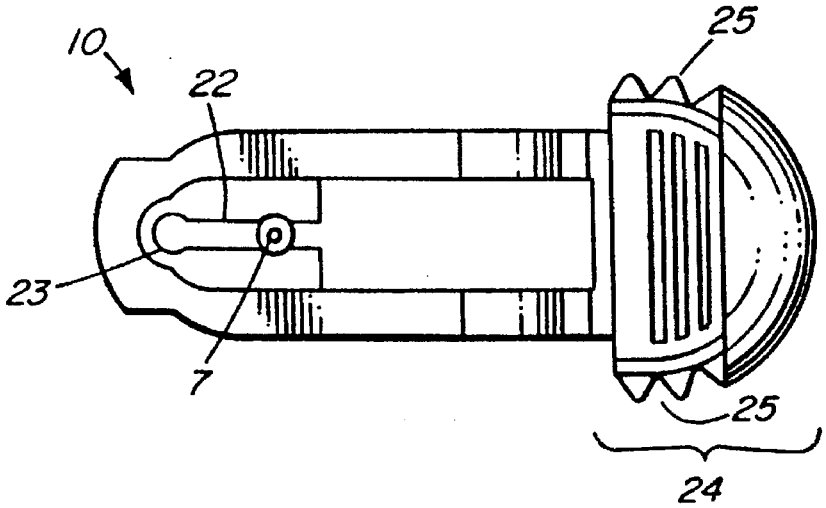
FIG. 4 is a top view of a lever employed in the present invention.
Figure 6:
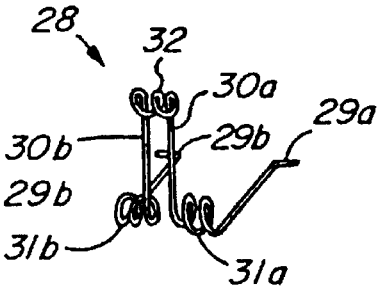
FIG. 6 is a perspective view of a double torsional spring employed in the embodiment of FIG. 1.

As illustrated in FIGS. 1–3, a coil spring 28 is connected to the lever 10 and is biased to resiliently urge the lever 10 toward the locked position by urging the second end of the lever 10 upwardly and to the left, as viewed in FIG. 1. The spring 28 can conveniently be formed of a piece of steel wire suitably bent to form fight and left bearing arms 29*a*, 29*b* and working arms 30*a*, 30*b* connected by respective right and left torsional spring coils 31*a*, 31*b* as illustrated in FIG. 6. The working arms 30*a*, 30*b* are connected by a coil or shackle 32 and a retaining pin 39 is inserted through the coil 32 and through opposite sides of the lever 10 to pivotally connect the shaping 28 over the lever 10. As shown in FIG. 6, the coil 32 can conveniently be formed by suitably bending the ends of the working arms 30*a*, 30*b* so that the spring 28 can be readily formed from a single length of wire. The retainer unit 17 includes a cross-piece 33 which extends through the right and left torsional spring coils 31*a*, 31*b*. The cross-piece 33 has one end integral with the support flange 21 of the locking unit 17 (see FIG. 5) and an opposite end shaped to abut the upper surface of the support flange 21. As illustrated in FIGS. 1–3, the dimensions of the cross-piece 33 are substantially smaller than the internal diameter of the right and left torsional spring coils 31*a* and 31*b*. This allows the right and left torsional spring coils 31*a* and 31*b* to move relative to the cross-piece 33, while at the same time permitting the cross-piece 33 to retain the spring 28 in an operative position between the lever and the tank cover 4.

Figure 7:
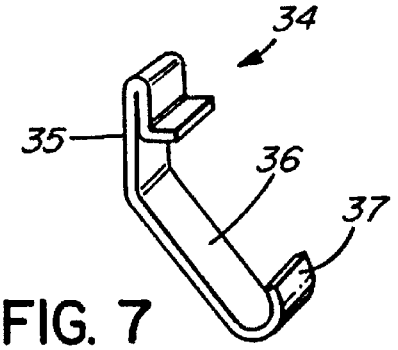
FIG. 7 is a perspective view of a latch hook employed in the embodiment of FIG. 1.

A second retainer in the form of a latch member or hook 34 (FIG. 7), is provided on the lever 10 so as to extend toward the retainer hook 20 of the locking unit 17. As illustrated in FIG. 7, the latch hook 34 is formed of a piece of metal suitably bent to form first or anchor portion 35, an inclined arm 36, and a second or hook portion 37 for operative engagement with the retainer hook 20 of the retainer unit 17. The latch hook 34 is fastened to the underside of the lever 10 by inserting the anchor portion 35 into a slot 40 formed in the underside of the lever 10 proximal the cavity 27. A small quantity of suitable adhesive (not shown) can be used to permanently bond the anchor portion 35 of the latch hook 34 or other retainer in place. Alternatively, the latch hook 34 can be made integrally with the lever 10.

As shown in FIGS. 1–3, the latch hook 34 is arranged so that when the lever 10 is in the locked position (FIG. 1), the latch hook 34 is disengaged from the hook 20 of the retainer unit 17; when the lever 10 is in the released position (FIG. 2), the latch hook 34 is engaged with the hook 20 of the retainer unit 17; and when the lever 10 is pivoted into an actuated position, in which it is shown in FIG. 3, to open the fuel valve 6, the latch hook 34 disengages from the retainer unit 17.

Employing the above construction, the first embodiment of the present invention operates generally as described below, again with reference to FIGS. 1–3. When the lighter 1 is not in use, the spring 28 retains the lever 10 in the locked position shown in FIG. 1. When it is desired to use the lighter 1, the user grasps the knurled portion 23 of the lever 10, and pulls the lever 10 outwards towards the released position until the latch hook 34 engages the hook 20 of the retainer unit 17 (see FIG. 2).

In the released position shown in FIG. 2, the abutment 26 is disengaged from the table 19 of the retainer unit 17, so that the lever 10 is free to pivot into its actuated position (FIG. 3) so as to open the fuel valve 6. The latch hook 34 and the retainer hook 20 co-operate to retain the lever 10 in the released position, against thewhen the use spring 28. However, when the user pivots the lever 10 to open the fuel valve 6, the latch hook 34 disengages from the retainer hook 20 of the retainer unit 17 (see FIG. 3).

As the user subsequently releases the lever 10 following use of the lighter 1, the spring 28 forces the lever 10 back towards the locked position, and prevents the latch hook 34 from reengaging with the retainer hook 20 of the retainer unit 17. It will thus be seen that each use of the lighter 1 requires that the user manually pull the lever 10 to the released position and that the lever 10 will automatically return, under the influence of the spring 28, to the locked position following each use. Thus, the safety features afforded by the locked position of the lever 10 cannot be defeated by the user neglecting to manually return the lever 10 to the locked position.

A second embodiment of the present invention is described hereinbelow with reference to FIGS. 8–10.

Figure 9:
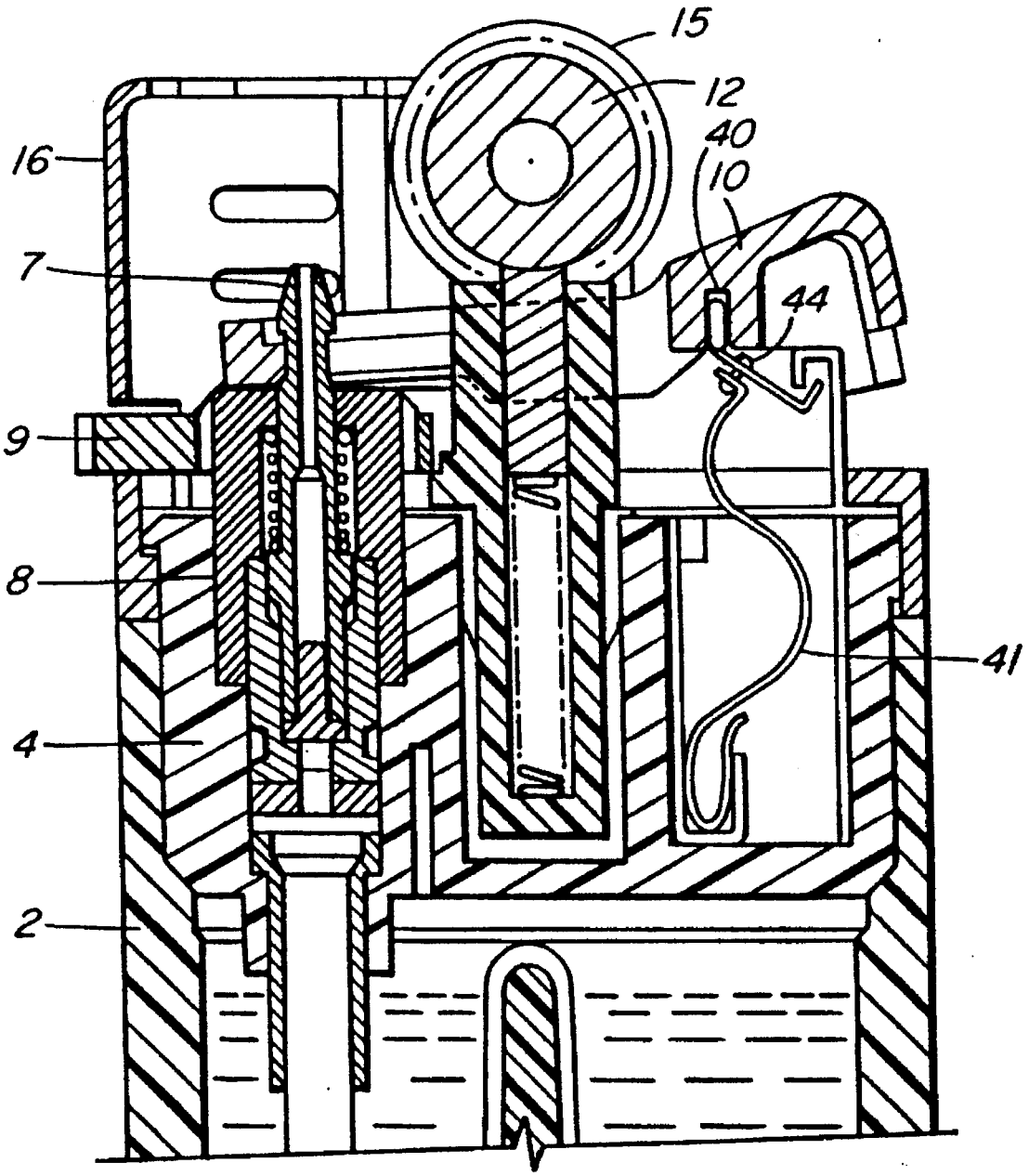
FIG. 9 is a cross-section view showing the embodiment of FIG. 8 in a released condition.
Figure 8:
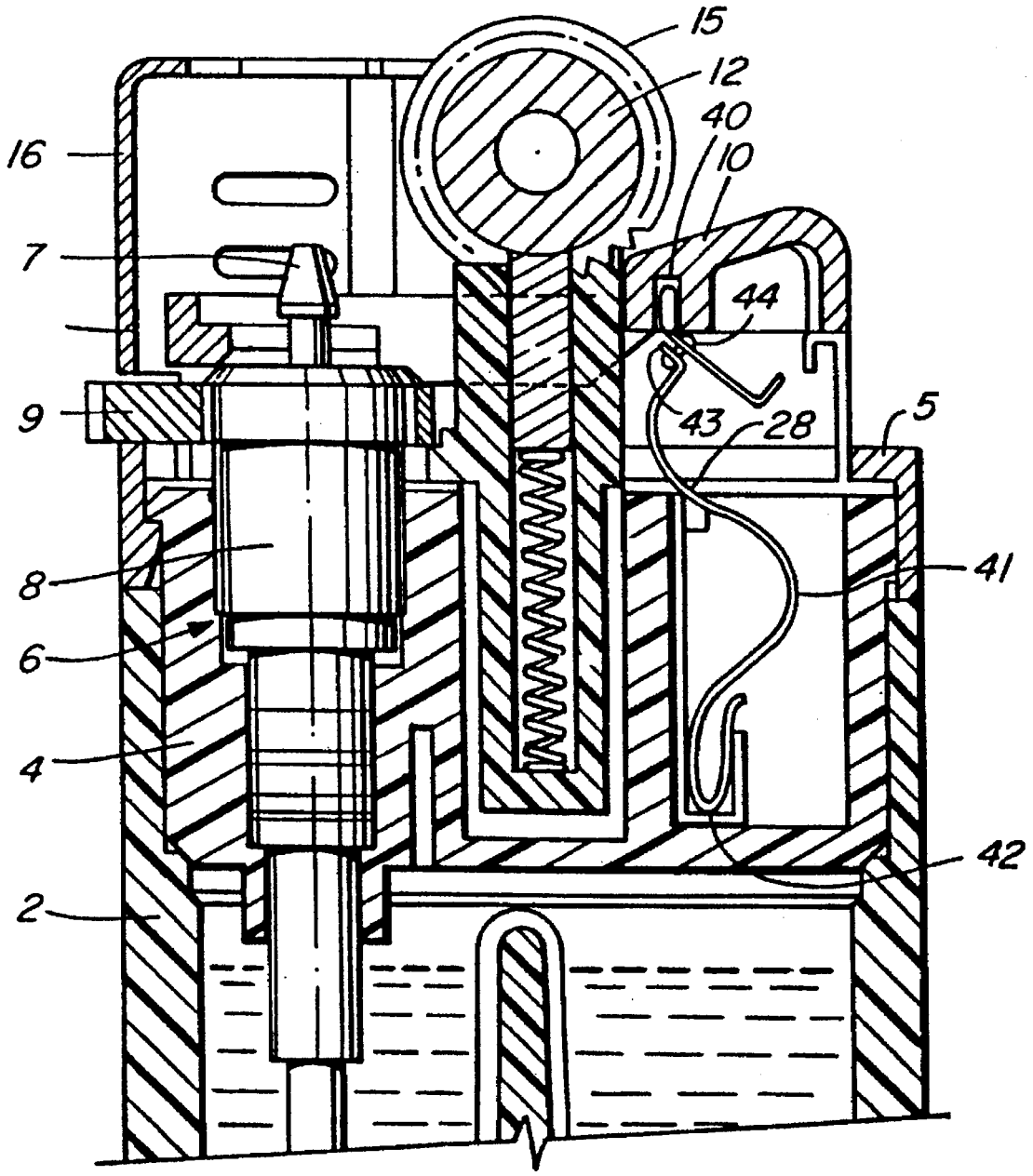
FIG. 8 is a cross-section view showing a second embodiment of the present invention in a locked condition.
Figure 10:
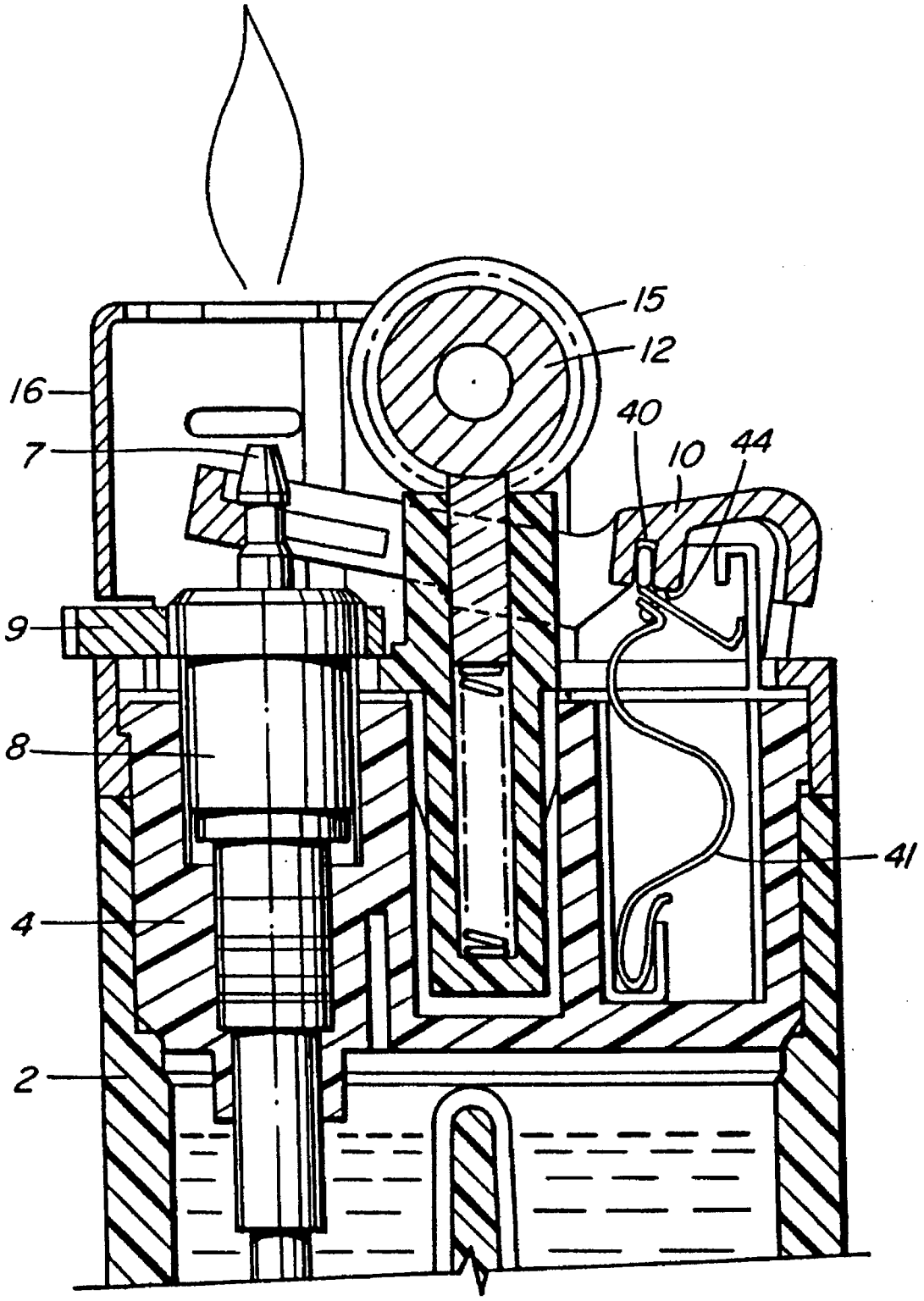
FIG. 10 is a cross-section view showing the embodiment of FIG. 8 in an in-use condition.

As shown in FIGS. 8–10, the component parts and general operation of the second embodiment of the present invention are closely similar to those of the first embodiment, except that an S-shaped reed spring 41 is used in place of the double torsion spring 28 of the first embodiment. The reed spring 41, which can be formed of a suitably bent piece of metal, conveniently includes a bent portion forming a bearing surface 42 at one end of the spring. The other end of the reed spring 41 is suitably formed with a bent portion or shackle 43, which is connected to a latch hook 46, by means of a rivet 44 as illustrated in FIGS. 8–10. The latch hook 46 has an upper end secured in the slot 40 in the underside of the lever 10 in a manner similar to that described above with reference to the actuator portion 35 of the latch hook 34.

Figure 11:
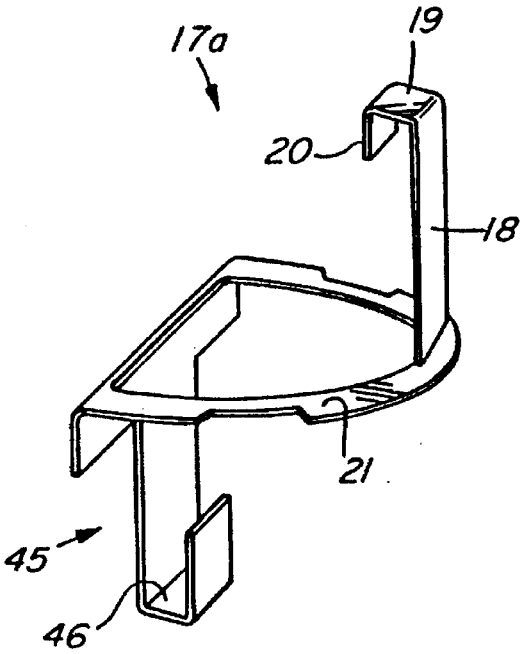
FIG. 11 is a perspective view of a locking unit employed in the embodiment of FIG. 8.

In this embodiment, the retainer unit 17 is replaced by a modified retainer unit 17*a* (FIG. 11), which has some ports which are similar to corresponding parts of the retainer unit 17 and which are therefore identified by the same reference numerals. The cross-piece 33 of the retainer unit 17 is replaced by, in the retainer unit 17*a*, an extension piece 45 forming a receptacle 46 for receiving the beating surface 42 of the reed spring 41. By this means, the bearing surface 42 of the reed spring 41 can be retained in place to ensure the proper operation of the spring 41.

While the present invention has been described above with reference to two of its embodiments, it will be understood that the same may be varied without departing from the scope of the appended claims.

I claim:

1. A child resistant lighter comprising:

a fuel tank;

a tank cover on said fuel tank;

a fuel valve operatively disposed in said tank cover for controllably releasing fuel from said tank;

a spark wheel, a flint and a spring mounted on said tank cover with said spring urging said flint against said spark wheel to direct a spark towards said fuel valve on rotation of said spark wheel to ignite fuel expelled through said fuel valve;

an abutment on said tank cover;

a lever attached to said tank cover and pivotable on said tank cover for actuating said fuel valve;

said lever having a first end operatively engaged with said fuel valve and a second end;

said lever being slidable, by manually pushing said lever, towards said fuel valve into a locked position, in which said fuel valve remains longitudinally closed and said second end engages said abutment to prevent pivoting of said lever relative to said tank cover, and also being longitudinally slidable, by manually pulling said lever away from said fuel valve, into a released position, in which said second end is released from said abutment and said lever is free to pivot relative to said tank cover from the released position to an actuated position so as to open said valve;

a spring resiliently urging said lever towards said fuel valve into the locked position;

a first retainer on said tank cover; and a second retainer on said lever, said second retainer being engageable with said first retainer against the action of said spring for releasably retaining said lever in the released position, and said second retainer being disengageable from said first retainer by pivoting of said lever from the released position to the actuated position, to thereby allow said lever to be automatically returned to the locked position by said spring following release of said lever from the actuated position.

2. A child resistant lighter as claimed in claim 1, wherein said second retainer comprises a latch member projecting from said lever between said lever and said tank cover.

3. A child resistant lighter as claimed in claim 2, wherein said lever is formed with a downwardly open slot and said latch member comprises a first portion secured in said slot and a second portion projecting downwardly therefrom.

4. A lighter as claimed in claim 1, wherein said spring comprises a torsional spring.

5. A lighter as claimed in claim 1, wherein said spring means comprises an S-shaped reed spring.

6. A child resistant lighter as claimed in claim 1, wherein said first retainer and said abutment form parts of a retainer unit mounted on said tank cover and said retainer unit further comprises a generally flat support flange for securing said retainer unit to said tank cover and a post extending from the support flange and substantially normal to the plane thereof, said post forming said abutment and said first retainer.

7. A lighter as claimed in claim 6, wherein said retainer unit further comprises a pivot and said spring comprises a torsional spring mounted on said pivot in operative relationship with said tank cover and said lever.

8. A lighter as claimed in claim 7, wherein said torsional spring comprises first arms bearing against an upper surface of said tank cover, and second arms extending to said lever and means pivotably connecting said second arms to said lever.

* * * * *